US009343015B2

(12) United States Patent
Jo

(10) Patent No.: US 9,343,015 B2
(45) Date of Patent: May 17, 2016

(54) ORGANIC LIGHT EMITTING DISPLAY DEVICE INCLUDING A SENSING UNIT FOR COMPENSATING DEGRADATION AND THRESHOLD VOLTAGE AND DRIVING METHOD THEREOF

(71) Applicant: SAMSUNG DISPLAY CO., LTD., Yongin, Gyeonggi-Do (KR)

(72) Inventor: Hyeon-Ja Jo, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 73 days.

(21) Appl. No.: 14/231,086

(22) Filed: Mar. 31, 2014

(65) Prior Publication Data

US 2015/0029171 A1 Jan. 29, 2015

(30) Foreign Application Priority Data

Jul. 24, 2013 (KR) ..... 10-2013-0087321

(51) Int. Cl.
*G09G 3/30* (2006.01)
*G09G 3/32* (2016.01)

(52) U.S. Cl.
CPC ..... *G09G 3/3258* (2013.01); *G09G 3/3233* (2013.01); *G09G 2320/0285* (2013.01); *G09G 2320/0295* (2013.01); *G09G 2320/045* (2013.01)

(58) Field of Classification Search
CPC ..... G09G 3/3233
USPC ..... 345/77
See application file for complete search history.

(56) References Cited

U.S. PATENT DOCUMENTS

| | | | | |
|---|---|---|---|---|
| 2006/0055631 | A1* | 3/2006 | Yoshida | 345/46 |
| 2007/0139311 | A1* | 6/2007 | Cho et al. | 345/76 |
| 2008/0074362 | A1 | 3/2008 | Ogura | |
| 2009/0027377 | A1* | 1/2009 | Kwon | 345/214 |
| 2011/0050674 | A1 | 3/2011 | Kim | |
| 2011/0130981 | A1* | 6/2011 | Chaji et al. | 702/58 |
| 2011/0254871 | A1* | 10/2011 | Yoo et al. | 345/690 |

FOREIGN PATENT DOCUMENTS

| | | |
|---|---|---|
| KR | 10-2008-0106191 | 4/2008 |
| KR | 10-2011-0024099 | 3/2011 |
| KR | 10-2012-0041453 | 5/2012 |

* cited by examiner

*Primary Examiner* — Long D Pham
(74) *Attorney, Agent, or Firm* — Lewis Roca Rothgerber Christie LLP

(57) ABSTRACT

An organic light emitting display device includes pixels each including a driving transistor and an organic light emitting diode, and a sensing unit configured to extract threshold voltage information of the driving transistor and degradation information of the organic light emitting diode from each of the pixels, wherein the sensing unit includes a conversion unit configured to convert pixel current supplied from a respective one of the pixels into a first voltage, and configured to convert a reference current from a current source into a second voltage, and a comparison unit configured to calculate a difference between the first voltage and the second voltage, and configured to output a comparison voltage corresponding to the difference.

17 Claims, 3 Drawing Sheets

ORGANIC LIGHT EMITTING DISPLAY DEVICE INCLUDING A SENSING UNIT FOR COMPENSATING DEGRADATION AND THRESHOLD VOLTAGE AND DRIVING METHOD THEREOF

CROSS-REFERENCE TO RELATED APPLICATION

This application claims priority to and the benefit of Korean Patent Application No. 10-2013-0087321, filed on Jul. 24, 2013, in the Korean Intellectual Property Office, the entire contents of which are incorporated herein by reference in their entirety.

BACKGROUND

1. Field

An aspect of embodiments of the present invention relates to an organic light emitting display device and a driving method thereof.

2. Description of the Related Art

With the development of information technologies, the importance of a display device, as a connection medium for information, increases. Accordingly, flat panel display devices (FPDs), such as a liquid crystal display (LCD) device, an organic light emitting display (OLED) device, and a plasma display panel (PDP), are increasingly used.

Among these FPD devices, the OLED device displays images using organic light emitting diodes that emit light through recombination of electrons and holes. The OLED device has a relatively fast response speed and is driven with relatively low power consumption.

SUMMARY

Embodiments of the present invention provide an organic light emitting display device and a driving method thereof, which can improve image quality.

According to an aspect of embodiments of the present invention, there is provided an organic light emitting display device including pixels each including a driving transistor and an organic light emitting diode, and a sensing unit configured to extract threshold voltage information of the driving transistor and degradation information of the organic light emitting diode from each of the pixels, wherein the sensing unit includes a conversion unit configured to convert pixel current supplied from a respective one of the pixels into a first voltage, and configured to convert a reference current from a current source into a second voltage, and a comparison unit configured to calculate a difference between the first voltage and the second voltage, and configured to output a comparison voltage corresponding to the difference.

The pixel current may be supplied from the driving transistor to the sensing unit via the organic light emitting diode.

The sensing unit may further include an analog-digital converter configured to convert the comparison voltage into a digital value, and a memory configured to store the digital value.

The conversion unit may include a first switch coupled between the current source and a node, and a resistor coupled between the node and a base power source.

The base power source may have a voltage value set so that the pixel current and the reference current flow to the base power source via the resistor.

The comparison unit may include a comparator configured to output the comparison voltage, a second switch coupled between a first terminal of the comparator and the node, a capacitor coupled between the first terminal of the comparator and the base power source, and a third switch coupled between a second terminal of the comparator and the node.

The first switch and the second switch may be configured to be concurrently turned on and off.

The first switch and the second switch may be configured to be turned on before the pixel current is supplied so that the second voltage is stored in the capacitor.

The third switch may be configured to be turned on when the pixel current is supplied.

The pixels may be located in an area defined by data lines, scan lines, first control lines, and a second control line.

The organic light emitting display device may further include a data driver configured to supply a data signal to the data lines during a driving period, and configured to supply a reference data signal to the data lines during a sensing period in which the threshold voltage information of the driving transistor and the degradation information of the organic light emitting diode are extracted, a scan driver configured to supply a scan signal to the scan lines during the driving period and the sensing period, a control line driver configured to supply a second control signal to the second control line during the driving period, and configured to progressively supply a first control signal to the first control lines during the sensing period, and a timing controller configured to generate a second data by changing bits of externally supplied first data according to the comparison voltage.

The first control signal supplied to an i-th (i is a natural number) first control line of the first control lines during the sensing period may be supplied after the scan signal is supplied to an i-th scan line of the scan lines.

One of the pixels positioned on an i-th (i is a natural number) horizontal line may further include a pixel circuit including the driving transistor to control current flowing from a first power source to a second power source via the organic light emitting diode, a first transistor coupled between a cathode electrode of the organic light emitting diode and the sensing unit, the first transistor being configured to be turned on when the first control signal is supplied to an i-th first control line of the first control lines, and a second transistor coupled between the cathode electrode of the organic light emitting diode and the second power source, the second transistor being configured to be turned on when the second control signal is supplied to the second control line.

The pixel circuit may include a fourth transistor coupled between a gate electrode of the driving transistor and a corresponding one of the data lines, the fourth transistor having a gate electrode coupled to an i-th scan line of the scan lines.

According to another aspect of embodiments of the present invention, there is provided a method of driving an organic light emitting display device, the method including converting reference current from a current source into a second voltage, converting pixel current, which is supplied via an organic light emitting diode and a driving transistor in a pixel, into a first voltage according to a reference data signal, converting a comparison voltage, which corresponds to a difference between the first and second voltages, into a digital value, and using the digital value to generate a second data by changing bits of an externally supplied first data.

The method may further include compensating a threshold voltage of the driving transistor and a degradation of the organic light emitting diode using the second data.

The method may further include storing the digital value in a memory.

BRIEF DESCRIPTION OF THE DRAWINGS

Example embodiments will be described more fully hereinafter with reference to the accompanying drawings. However, they may be embodied in different forms, and should not be construed as being limited to the specific embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it may be the only element between the two elements, or one or more intervening elements may be present. Like reference numerals refer to like elements throughout.

DETAILED DESCRIPTION

Figure 1:
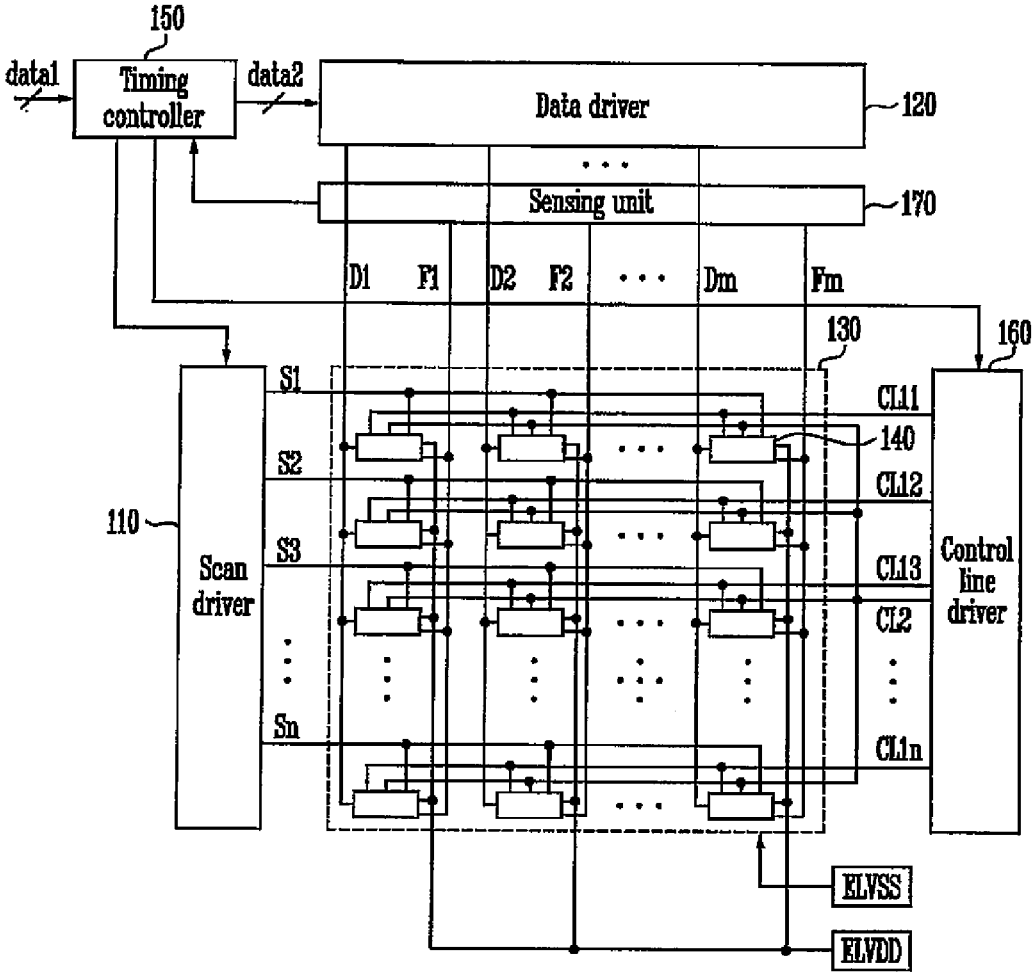
FIG. 1 is a diagram illustrating an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more other elements. Further, some of the elements that are not essential to the complete understanding of the invention are omitted for clarity. Also, like reference numerals refer to like elements throughout. Additionally, terms such as "first," "second," and "third," as used in the claims, are merely used to delineate elements, and do not necessarily reflect the total number of elements present in the various embodiments of the present invention.

FIG. 1 is a diagram illustrating an organic light emitting display device according to an embodiment of the present invention.

Referring to FIG. 1, the organic light emitting display device according to the present embodiment includes a display unit 130 including pixels 140 positioned at crossing regions of scan lines S1 to Sn and data lines D1 to Dm, a scan driver 110 configured to drive the scan lines S1 to Sn, a data driver 120 configured to drive the data lines D1 to Dm, a control line driver 160 configured to drive first control lines CL11 to CL1*n* and a second control line CL2, and a timing controller 150 configured to control the scan driver 110, the data driver 120, and the control line driver 160.

The organic light emitting display device according to the present embodiment further includes a sensing unit 170 configured to extract threshold voltage information of a driving transistor in each pixel 140, and to extract degradation information of an organic light emitting diode in each pixel 140, using feedback lines F1 to Fm.

The display unit 130 includes the pixels 140 positioned in an area defined by the scan lines S1 to Sn and the data lines D1 to Dm. During a sensing period, each pixel 140 provides, to the sensing unit 170, current, which includes the threshold voltage information of the driving transistor, and the degradation information of the organic light emitting diode. Each pixel 140 receives a data signal input during a driving period, and generates light (e.g., light with a predetermined luminance) while controlling the amount of current supplied from a first power source ELVDD to a second power source ELVSS via the organic light emitting diode, corresponding to the received data signal.

The scan driver 110 supplies a scan signal to the scan lines S1 to Sn. For example, the scan driver 110 progressively supplies the scan signal to the scan lines S1 to Sn during the sensing and driving periods. Here, the scan signal is set to a voltage configured to turn on the transistors included in the pixels 140.

The data driver 120 supplies a reference data signal to the data lines D1 to Dm during the sensing period. Here, the reference data signal refers to a data signal that has a voltage (e.g., a specific voltage) within the voltage range of data signals. During the sensing period, each pixel 140 charges a voltage corresponding to the reference data signal.

The data driver 120 receives a second data data2 supplied during the driving period, and generates a data signal using the supplied second data data2. The data signal generated in the data driver 120 is supplied to the data lines D1 to Dm in synchronization with the scan signal.

The control line driver 160 supplies a second control signal to the second control line CL2, which is commonly coupled to the pixels 140, during the driving period. The control line driver 160 supplies a first control signal to the first control lines CL11 to CL1*n*, which are respectively located on horizontal lines, during the sensing period. For example, the control line driver 160 may progressively supply the first control signal to the first control lines CL11 to CL1*n* during the sensing period. When the first control signal is progressively supplied to the first control lines CL11 to CL1*n*, pixels 140 are coupled to the feedback lines F1 to Fm for each horizontal line. Here, the first and second control signals are set to a voltage at which the transistors included in the pixels 140 can be turned on.

The sensing unit 170 is coupled to the pixels 140 for each horizontal line via the feedback lines F1 to Fm during the sensing period. In this case, the sensing unit 170 extracts, from each pixel 140, the threshold voltage information of the driving transistor, and the degradation information of the organic light emitting diode.

The timing controller 150 controls the scan driver 110, the data driver 120, the control line driver 160, and the sensing unit 170. The timing controller 150 receives the threshold voltage and the degradation information supplied from the sensing unit 170, and generates the second data data2 by changing a first data data1, corresponding to externally supplied information (e.g., information supplied from the outside of the organic light emitting display device). Here, the second data data2 is set so that light with the same luminance can be generated in the pixels 140 when the same data signal is supplied.

Figure 2:
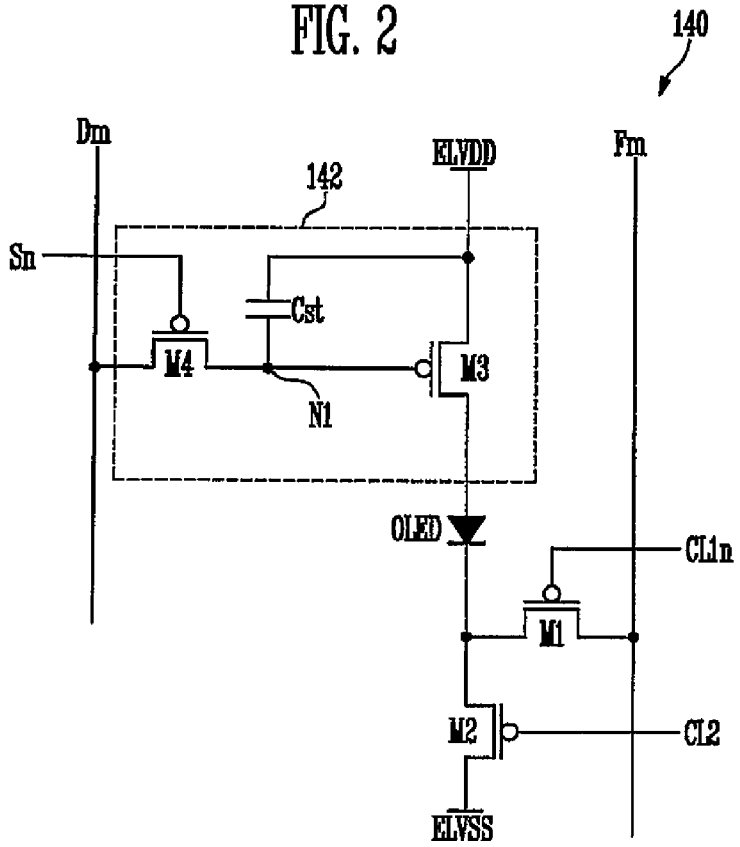
FIG. 2 is a circuit diagram illustrating a pixel according to an embodiment of the present invention.

FIG. 2 is a circuit diagram illustrating a pixel according to an embodiment of the present invention. For convenience of illustration, a pixel coupled to an m-th data line Dm and to an n-th scan line Sn will be shown in FIG. 2.

Referring to FIG. 2, the pixel 140 according to the present embodiment includes an organic light emitting diode OLED, a pixel circuit 142 configured to control the amount of current supplied to the organic light emitting diode OLED, and first and second transistors M1 and M2.

An anode electrode of the organic light emitting diode OLED is coupled to the pixel circuit 142, and a cathode electrode of the organic light emitting diode OLED is coupled to the second power source ELVSS via the second transistor M2. The organic light emitting diode OLED generates light (e.g., light with a predetermined luminance) corresponding to current supplied from the pixel circuit 142.

The pixel circuit 142 supplies a current (e.g., a predetermined current) to the organic light emitting diode OLED, the current corresponding to a data signal. The pixel circuit 142 may be implemented as various types of circuits currently known in the art. For example, the pixel circuit 142 may include a third transistor M3, a fourth transistor M4, and a storage capacitor Cst.

A first electrode of the third transistor (driving transistor) M3 is coupled to the first power source ELVDD, and a second electrode of the third transistor M3 is coupled to the anode electrode of the organic light emitting diode OLED. The third transistor M3 controls the amount of current supplied to the organic light emitting diode OLED according to a voltage applied to a first node N1.

A first electrode of the fourth transistor M4 is coupled to the data line Dm, and a second electrode of the fourth transistor M4 is coupled to the first node N1. A gate electrode of the fourth transistor M4 is coupled to the scan line Sn. The fourth transistor M4 is turned on when a scan signal is supplied to the scan line Sn to allow the data line Dm and the first node N1 to be electrically coupled to each other.

The storage capacitor Cst is coupled between the first power source ELVDD and the first node N1. The storage capacitor Cst stores a voltage corresponding to the data signal.

A first electrode of the first transistor M1 is coupled to the cathode electrode of the organic light emitting diode OLED, and a second electrode of the first transistor M1 is coupled to a feedback line Fm. A gate electrode of the first transistor M1 is coupled to a first control line CL1*n*. The first transistor M1 is turned on when a first control signal is supplied to the first control line CL1*n* to allow the feedback line Fm to be electrically coupled to the cathode electrode of the organic light emitting diode OLED.

A first electrode of the second transistor M2 is coupled to the cathode electrode of the organic light emitting diode OLED, and a second electrode of the second transistor M2 is coupled to the second power source ELVSS. A gate electrode of the second transistor M2 is coupled to a second control line CL2. The second transistor M2 is turned on when a second control signal is supplied to the second control line CL2 to allow the cathode electrode of the organic light emitting diode OLED to be electrically coupled to the second power source ELVSS.

For example, the second control signal is supplied to the second control line CL2 during a driving period in which an image (e.g., a predetermined image) is displayed on the display unit 130. Then, the second transistor M2 is turned on during the driving period so that the current from the organic light emitting diode OLED can flow to the second power source ELVSS. The second transistor M2 is turned off during a sensing period, during which the current from the organic light emitting diode OLED may be supplied to the sensing unit 170 via the first transistor M1 and the feedback line Fm.

Figure 3:
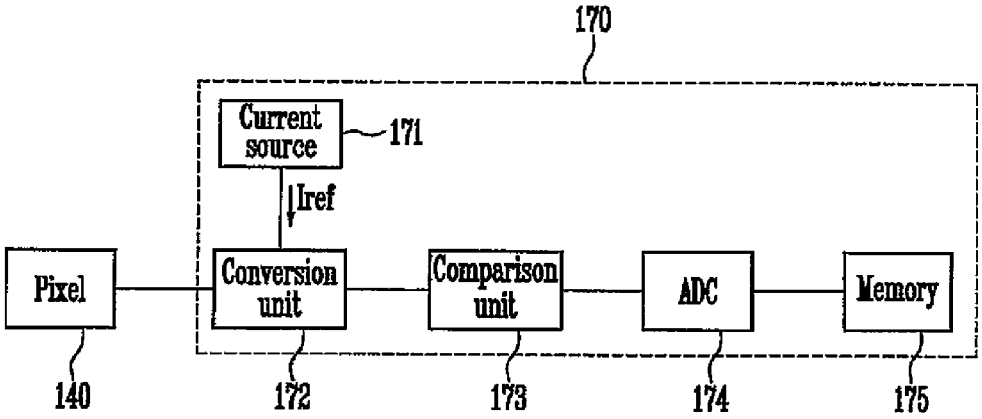
FIG. 3 is a diagram illustrating an embodiment of a sensing unit shown in FIG. 1.

FIG. 3 is a diagram illustrating an embodiment of the sensing unit shown in FIG. 1. For convenience of illustration, only one channel will be shown in FIG. 3.

Referring to FIG. 3, the sensing unit 170 according to the present embodiment includes a current source 171, a conversion unit 172, a comparison unit 173, an analog-digital converter (hereinafter, referred to as "ADC") 174 and a memory 175.

The current source 171 supplies reference current Iref to the conversion unit 172, the reference current Iref corresponding to the reference data signal.

The conversion unit 172 converts pixel current supplied from the pixel 140 into a first voltage, and converts the reference current Iref supplied from the current source 171 into a second voltage.

The comparison unit 173 compares the first and second voltages received from the conversion unit, and supplies a comparison voltage to the ADC 174.

The ADC 174 receives the comparison voltage received from the comparison unit 173, and converts the input comparison voltage into a digital value.

The memory 175 stores the digital value supplied from the ADC 174. For example, a digital value (e.g., the digital value representing threshold voltage and degradation information) corresponding to each pixel is stored in the memory 175. The digital value stored in the memory 175 is supplied to the timing controller 150. The timing controller 150 generates the second data data2 by changing bits of the first data data1 by using the digital value stored in the memory 175, so that the threshold voltage information of the driving transistor in each pixel, as well as the degradation information of the organic light emitting diode in each pixel, can be compensated.

Figure 4:
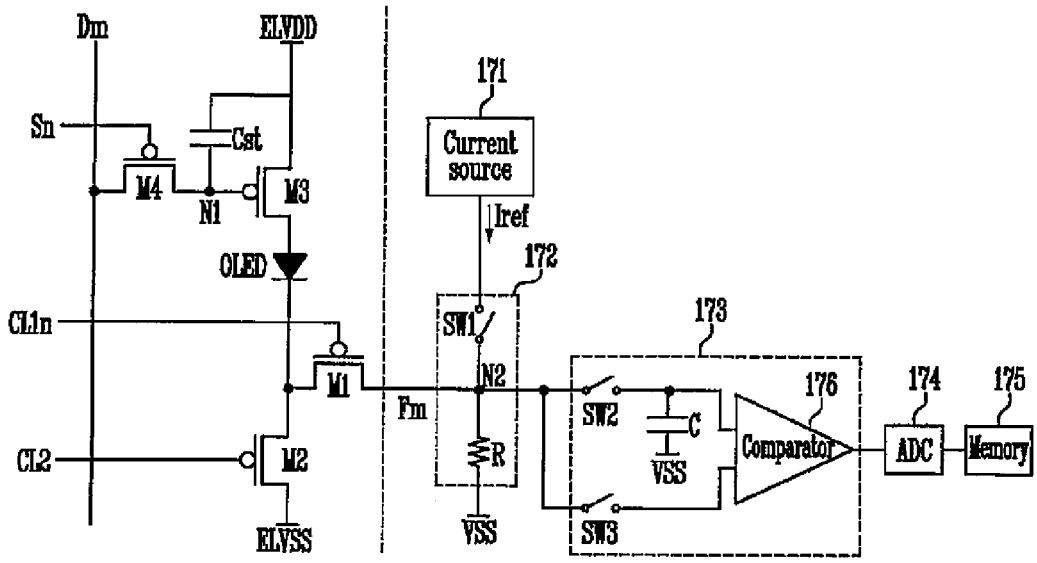
FIG. 4 is a circuit diagram illustrating an embodiment of conversion and comparison units shown in FIG. 3.

FIG. 4 is a circuit diagram illustrating an embodiment of the conversion unit and the comparison unit shown in FIG. 3.

Referring to FIG. 4, the conversion unit 172 includes a resistor R, which is coupled between a second node N2 and a base power source VSS, and a first switch SW1, which is coupled between the second node N2 and a current source 171.

The base power source VSS has a voltage value set so that the pixel current from the pixel 140 and the reference current ref from the current source 171 can flow into the base power source VSS via the resistor R.

The first switch SW1 turns on before the first transistor M1 is turned on. When the first switch SW1 is turned on, current can flow into the base power source VSS via the resistor R, and accordingly, the second voltage from the conversion unit 172 is applied to the second node N2.

The comparison unit 173 includes a second switch SW2, a third switch SW3, a capacitor C, and a comparator 176.

The capacitor C is coupled between a first terminal of the comparator 175 and the base power source VSS. The capacitor C charges the second voltage.

The second switch SW2 is coupled between the first terminal of the comparator 176 and the second node N2. The second switch SW2 is simultaneously turned on with and turned off with the first switch SW1. Thus, when the second switch SW2 is turned on, the second voltage applied to the second node N2 is stored in the capacitor C.

The third switch SW3 is coupled between a second terminal of the comparator 176 and the second node N2. The third switch SW3 is simultaneously turned on with and turned off with the first transistor M1. Accordingly, when the third switch SW3 is turned on, the first voltage applied to the second node N2 is supplied to the second terminal of the comparator 176.

The comparator 176 compares the first and second voltages, and supplies a comparison voltage, which corresponds to the difference between the first and second voltages, to the ADC 174.

Figure 5:
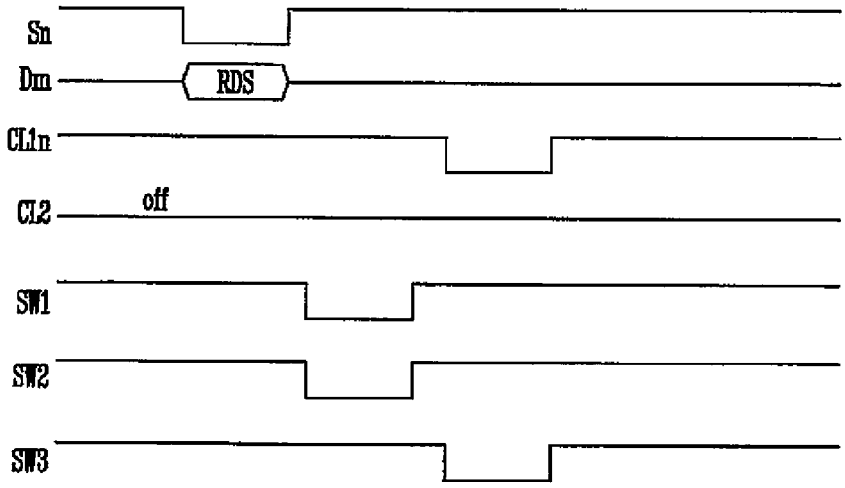
FIG. 5 is a waveform diagram illustrating an operating process during a sensing period.

FIG. 5 is a waveform diagram illustrating an operating process during a sensing period.

Referring to FIG. 5, first, the scan signal is progressively supplied to the scan lines S1 to Sn during the sensing period. In addition, the first control signal is progressively supplied to the first control lines CL11 to CL1*n* during the sensing period. Here, the first control signal supplied to an i-th (i is a natural number) first control line CL1*i* is supplied after the scan signal is supplied to an i-th scan line Si.

Additionally, the second control signal is not supplied to the second control line CL2 during the sensing period, and accordingly, the second transistor M2 included in each pixel 140 is set in a turn-off state.

When the scan signal is supplied to the n-th scan line Sn, the fourth transistor M4 is turned on. When the fourth transistor M4 is turned on, a reference data signal RDS from the data line Dm is supplied to the first node N1. Then, the third transistor M3 supplies pixel current corresponding to the reference data signal RDS via the organic light emitting diode OLED.

After the scan signal is supplied to the n-th scan line Sn, the first and second switches SW1 and SW2 are turned on. When the first switch SW1 is turned on, the reference current Iref from the current source 171 is supplied to the reference power source VSS via the resistor R. In this case, the second voltage applied to the second node N2 is stored in the capacitor C via the second switch SW2.

When, the first and second switches SW1 and SW2 are turned on to store the second voltage in the capacitor C, the first and second switches SW1 and SW2 may be turned on at least once during the sensing period. For example, the turn-on period of the first and second switches SW1 and SW2 may overlap with the supply period of the scan signal to the scan line Sn. Also, the first and second switches SW1 and SW2 may be turned on once at an early stage of the sensing period. In this case, the second voltage is previously charged in the capacitor C at the early stage of the sensing period.

After the second voltage is charged in the capacitor C, a control signal is supplied to the first control line CL1*n*, and the third switch SW3 is turned on. When the control signal is supplied to the first control line CL1*n*, the first transistor M1 is turned on. When the first transistor M1 is turned on, the pixel current from the third transistor M3 flows to the base power source VSS via the organic light emitting diode OLED, the first transistor M1, and the resistor R. In this case, the first voltage is applied to the second node N2.

The first voltage applied to the second node N2 is supplied to the second terminal of the comparator 176 via the third switch SW3. In this case, the comparator 176 compares the second and first voltages respectively applied to the first and second terminals thereof, and supplies a comparison voltage to the ADC 174.

The ADC 174 converts the comparison voltage into a digital value, and stores the converted digital value in the memory 175.

Actually, in the present embodiment, the digital value of each pixel 140 is stored in the memory by repeating the aforementioned procedure during the sensing period. In the present embodiment, the degradation information of the driving transistor M3 and the organic light emitting diode OLED can be extracted (e.g., simultaneously extracted) during the sensing period, and accordingly, it is possible to reduce or minimize the sensing period. Additionally, in the present embodiment, the reference current Iref and the pixel current are converted into a voltage, using the resistor R, without adding any separate capacitor, etc. When the reference current Iref and the pixel current are converted to the voltage, as described above, it is possible to increase a driving speed.

Meanwhile, although the transistors described in the example embodiments of the present invention are shown as PMOS transistors, the present invention is not limited thereto. In other words, the transistors may be formed as NMOS transistors.

In the present embodiment, the organic light emitting diode OLED may generate red, green, and blue light corresponding to the amount of current supplied from the driving transistor, or may generate white light corresponding to the amount of the current supplied from the driving transistor. When the organic light emitting diode OLED generates white light, a color image can be implemented using a separate color filter or the like.

By way of summation and review, an organic light emitting display device includes a plurality of pixels arranged in a matrix form at crossing regions of a plurality of data lines, a plurality of scan lines, and a plurality of power lines. Each pixel generally includes an organic light emitting diode and a driving transistor configured to control the amount of current flowing through the organic light emitting diode. The pixel generates light (e.g., light with a predetermined luminance) while supplying current from the driving transistor to the organic light emitting diode according to a data signal.

The organic light emitting display device might not display a uniform image due to degradation of the organic light emitting diode and variation in the threshold voltage of the driving transistor. To solve such a problem, there is a method for compensating for the degradation of the organic light emitting diode and the threshold voltage of the driving transistor from outside of the organic light emitting display device. However, in the method, the degradation of the organic light emitting diode in each pixel, and the threshold voltage of the driving transistor in each pixel, are extracted in a separate period, and hence unnecessary time is wasted.

In the organic light emitting display device and the driving method thereof according to embodiments of the present invention, the degradation information of the organic light emitting diode and the threshold voltage information of the driving transistor are simultaneously extracted, and accordingly, it is possible to reduce the sensing period. Further, data are controlled so that the degradation of the organic light emitting diode and the threshold voltage of the driving transistor are compensated using the extracted information, thereby improving image quality.

Example embodiments have been disclosed herein, and although specific terms are employed, they are used and are to be interpreted in a generic and descriptive sense only, and are not to be used for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. An organic light emitting display device comprising:

pixels each comprising a driving transistor and an organic light emitting diode; and a sensing unit configured to extract threshold voltage information of the driving transistor and degradation information of the organic light emitting diode from each of the pixels, wherein the sensing unit comprises:

a conversion unit configured to convert pixel current supplied from a respective one of the pixels into a first voltage, and configured to convert a reference current from a current source into a second voltage during a period when the conversion unit is electrically decoupled from the respective one of the pixels; and a comparison unit configured to calculate a difference between the first voltage and the second voltage, and configured to output a comparison voltage corresponding to the difference.

2. The organic light emitting display device of claim 1, wherein the pixel current is supplied from the driving transistor to the sensing unit via the organic light emitting diode.

3. The organic light emitting display device of claim 1, wherein the sensing unit further comprises:

an analog-digital converter configured to convert the comparison voltage into a digital value; and a memory configured to store the digital value.

4. The organic light emitting display device of claim 1, wherein the conversion unit comprises:

a first switch coupled between the current source and a node; and a resistor coupled between the node and a base power source.

5. The organic light emitting display device of claim 4, wherein the base power source has a voltage value set so that the pixel current and the reference current flow to the base power source via the resistor.

6. The organic light emitting display device of claim 1, wherein the pixels are located in an area defined by data lines, scan lines, first control lines, and a second control line.

7. The organic light emitting display device of claim 6, further comprising:

a data driver configured to supply a data signal to the data lines during a driving period, and configured to supply a reference data signal to the data lines during a sensing period in which the threshold voltage information of the driving transistor and the degradation information of the organic light emitting diode are extracted;

a scan driver configured to supply a scan signal to the scan lines during the driving period and the sensing period;

a control line driver configured to supply a second control signal to the second control line during the driving period, and configured to progressively supply a first control signal to the first control lines during the sensing period; and a timing controller configured to generate a second data by changing bits of externally supplied first data according to the comparison voltage.

8. The organic light emitting display device of claim 7, wherein the first control signal supplied to an i-th (i is a natural number) first control line of the first control lines during the sensing period is supplied after the scan signal is supplied to an i-th scan line of the scan lines.

9. The organic light emitting display device of claim 7, wherein one of the pixels positioned on an i-th (i is a natural number) horizontal line further comprises:

a pixel circuit comprising the driving transistor to control current flowing from a first power source to a second power source via the organic light emitting diode;

a first transistor coupled between a cathode electrode of the organic light emitting diode and the sensing unit, the first transistor being configured to be turned on when the first control signal is supplied to an i-th first control line of the first control lines; and a second transistor coupled between the cathode electrode of the organic light emitting diode and the second power source, the second transistor being configured to be turned on when the second control signal is supplied to the second control line.

10. The organic light emitting display device of claim 9, wherein the pixel circuit comprises a fourth transistor coupled between a gate electrode of the driving transistor and a corresponding one of the data lines, the fourth transistor having a gate electrode coupled to an i-th scan line of the scan lines.

11. An organic light emitting display device comprising:

pixels each comprising a driving transistor and an organic light emitting diode; and a sensing unit configured to extract threshold voltage information of the driving transistor and degradation information of the organic light emitting diode from each of the pixels, wherein the sensing unit comprises:

a conversion unit configured to convert pixel current supplied from a respective one of the pixels into a first voltage, and configured to convert a reference current from a current source into a second voltage; and a comparison unit configured to calculate a difference between the first voltage and the second voltage, and configured to output a comparison voltage corresponding to the difference, wherein the conversion unit comprises:

a first switch coupled between the current source and a node; and a resistor coupled between the node and a base power source, and wherein the comparison unit comprises:

a comparator configured to output the comparison voltage;

a second switch coupled between a first terminal of the comparator and the node;

a capacitor coupled between the first terminal of the comparator and the base power source; and a third switch coupled between a second terminal of the comparator and the node.

12. The organic light emitting display device of claim 11, wherein the first switch and the second switch are configured to be concurrently turned on and off.

13. The organic light emitting display device of claim 11, wherein the first switch and the second switch are configured to be turned on before the pixel current is supplied so that the second voltage is stored in the capacitor.

14. The organic light emitting display device of claim 11, wherein the third switch is configured to be turned on when the pixel current is supplied.

15. A method of driving an organic light emitting display device, the method comprising:

converting reference current from a current source into a second voltage;

converting pixel current, which is supplied via an organic light emitting diode and a driving transistor in a pixel, into a first voltage according to a reference data signal;

converting a comparison voltage, which corresponds to a difference between the first and second voltages, into a digital value; and using the digital value to generate a second data by changing bits of an externally supplied first data, wherein the converting of the reference current occurs during a period during which the pixel is electrically decoupled from the current source.

16. The method of claim 15, further comprising compensating a threshold voltage of the driving transistor and a degradation of the organic light emitting diode using the second data.

17. The method of claim 15, further comprising storing the digital value in a memory.

* * * * *